US005515665A

United States Patent [19]

Wegman

[11] Patent Number: 5,515,665

[45] Date of Patent: May 14, 1996

[54] METHOD AND APPARATUS FOR POSITIONING A CLOSURE ON A CONTAINER

[75] Inventor: Paul M. Wegman, Pittsford, N.Y.

[73] Assignee: Xerox Corporation, Stamford, Conn.

[21] Appl. No.: 429,257

[22] Filed: Apr. 25, 1995

[51] Int. Cl.[6] ..... B65B 7/28

[52] U.S. Cl. ..... 53/488; 53/485; 53/332; 53/292

[58] Field of Search ..... 53/133.3, 485, 53/412, 488, 377.8, 332, 487, 292, 296

[56] References Cited

U.S. PATENT DOCUMENTS

| | | | |
|---|---|---|---|
| 2,355,073 | 8/1944 | Hothersall | 53/488 |
| 3,355,166 | 11/1967 | Plumb . | |
| 3,508,380 | 4/1970 | Nakamura | 53/488 |
| 3,621,637 | 11/1971 | Sternau | 53/488 |
| 3,908,340 | 9/1975 | Erhardt | 53/307 |
| 4,062,385 | 12/1977 | Katusha | 141/89 |
| 4,464,154 | 8/1984 | Ljungcrantz | 53/412 |
| 4,782,646 | 11/1988 | Nantin | 53/412 |

*Primary Examiner*—John Sipos
*Assistant Examiner*—Gene L. Kim

[57] ABSTRACT

A method of and apparatus for closing a container such that a container which has a sealed closure with a tab extending from it travels along a conveyor past a vacuum source which releasably secures the tab. As the container continues to move along the conveyor, the tab is pulled taut by the vacuum force. When the container reaches a predetermined position, it is raised off the conveyor with a yoke, the tab still being pulled taut by the vacuum force, and the top of the container, the sealed closure and the tab are pinched against a stop. At this position the tab is aligned, taut and clamped in place over the container opening so that a lid may be placed on the container.

18 Claims, 2 Drawing Sheets

METHOD AND APPARATUS FOR POSITIONING A CLOSURE ON A CONTAINER

This invention relates generally to a method of and apparatus for covering a container and more specifically concerning a method and apparatus for covering a container which has a pull tab attached to a portion of a sealed closure and the placement of a lid thereon. The tab must be properly positioned over the sealed portion of the closure in order for the lid to be placed on the container.

In particular, the container is a toner container which is designed to cooperate with a toner receptacle in an electrophotographic machine so that the operator replenishing the toner supply is not exposed to contact with the toner. This is accomplished by having a sealed toner container which has a pull tab integrally attached to the sealed closure and covered by a slidable lid. The pull tab is folded over the sealed closure and extends between the top of the container and the lid. When placing the toner container on the toner receptacle, the container lid is held stationary with respect to the toner receptacle while the container is slid into place. After the lid is slid into place over the toner receptacle, the tab is pulled by an operator in the direction opposite to the container movement which removes the sealed closure from the toner container. Thus, only the toner receptacle is exposed to the opened container.

It is known to manually fold a pull tab over a sealed closure portion and to manually hold the tab in place while a lid is placed on a sealed container. However, it is desirable to carry out the tab orientation and placement process by a machine in order to increase the efficiency and productivity of the container covering process.

Various mechanized techniques using vacuum sources have been used in packaging containers. The following patents teach various methods of using such machines in the packaging process:

U.S. Pat. No. 3,355,166

Patentee: Plumb

Issued: Nov. 28, 1967

U.S. Pat. No. 3,908,340

Patentee: Erhardt

Issued: Sept. 30, 1975.

The pertinent portions of the foregoing patents may be briefly summarized as follows:

U.S. Pat. No. 3,355,166 discloses an automatic wrapping machine with a suction stop plate. A cut sheet of wrapping material is positively held to conveyor belts by suction and when the sheet reaches the wrapping position, suction is created at the surface of the suction stop plate to hold the sheet in place while the article is wrapped.

U.S. Pat. No. 3,908,340 describes an apparatus for feeding and applying lids to containers along a conveyor belt. The lid feeder includes a vacuum cup moved in relation to the advance of the conveyor to withdraw an individual lid from a magazine and move the same downwardly and forwardly in the direction of advance of the containers by the conveyor. A tack sealing mechanism seals a portion of the lid to the rim of a container as the vacuum cup moves forwardly with an advancing container and a lid sealing mechanism seals the lid to the entire rim of the container as the container is advanced past a subsequent lid sealing station.

In accordance with one aspect of the present invention, there is provided a method of positioning a closure for a container which includes attaching a first portion of the closure to the container. A second portion of the closure is releasably secured and the closure is maintained under tension. The closure and container are positioned relative to one another to place the closure in a covering relationship with an opening in the container.

Pursuant to another aspect of the present invention, there is provided an apparatus for positioning a closure having a first end thereof attached to a container moving along a path. There are means for releasably securing a second end of the closure and means to maintain the closure under tension as the container moves along the path. Finally, there are means, responsive to the closure being maintained under tension, for moving the container in a direction substantially transverse to the path to position the second end of the closure in a covering relationship with an opening in the container.

Figure 1A:
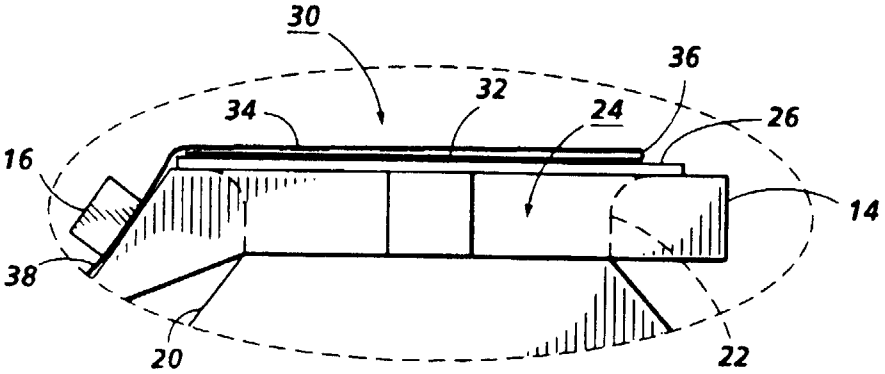
FIG. 1A shows a detail of the container covering of the elevational view.

While the present invention will be described hereinafter in conjunction with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like reference numerals have been used throughout to designate identical elements. The container shown in the drawings is that of a toner container, however the container packaging method and machine are equally well suited for use with a wide variety of containers.

Figure 1:
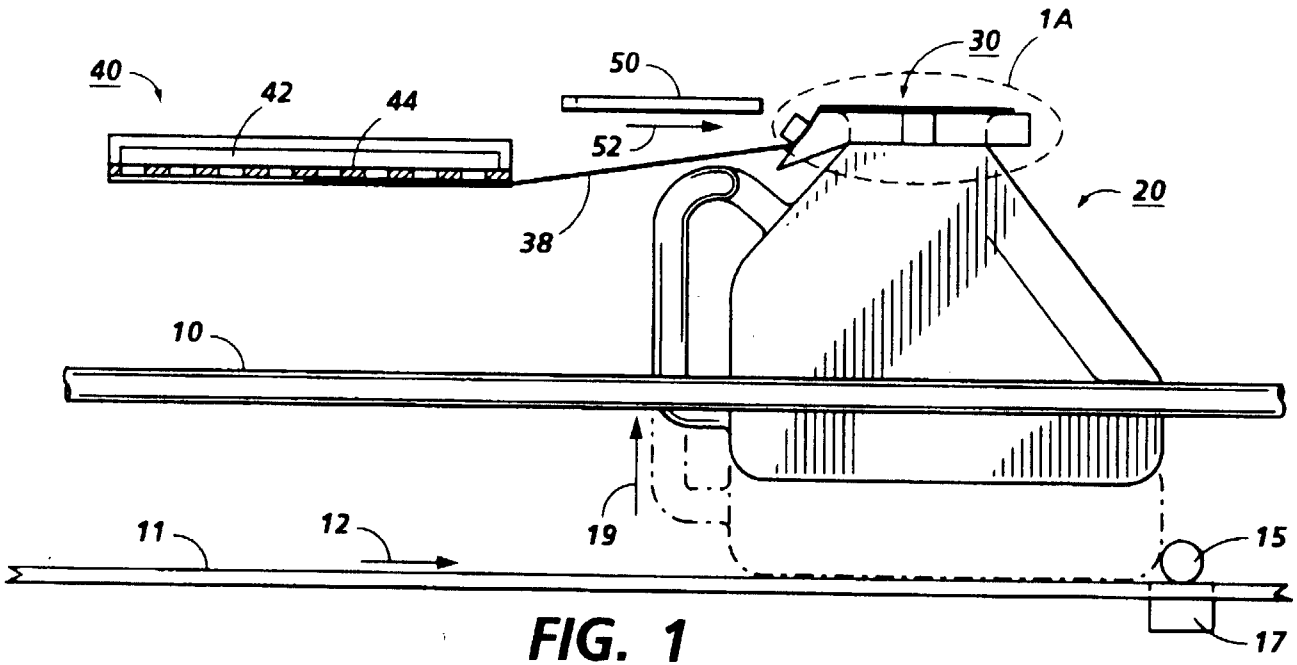
FIG. 1 shows an elevational view of the container covering machine embodying the present invention.

As shown in FIG. 1 the sealed container advances along guide rails 10 by a conveyor 11 in the direction of arrow 12. The conveyor is preferably a tabletop conveyor belt which holds the container in place by the friction between the container bottom and the belt.

The container 20 is a molded plastic container made, for example, from polyethylene, polypropylene, polyallomer, or a copolymer of these resins. A neck portion 22 of the container terminates in a rectangular shaped open end 24 with a flat flange portion 26 located peripherally about the neck. An exemplary toner container is described in U.S. Pat. No. 4,062,385.

A closure member 30 is constructed, for example, of polyester film coated with a hot melt adhesive. The closure member includes a sealed portion 32 which is secured to the container flange 26 over the open end 24. The closure member 30 includes a tab 34 integrally formed with the sealed portion 32. The tab is doubled back over the sealed portion resulting in fold 36. At the opposite end of the fold, tab 34 terminates in a free leading end 38 which extends beyond the container and which when pulled separates the sealed portion from the container flange. The fold 36 is oriented at the front of the container as the container advances down the conveyor guide rail.

Figure 2:
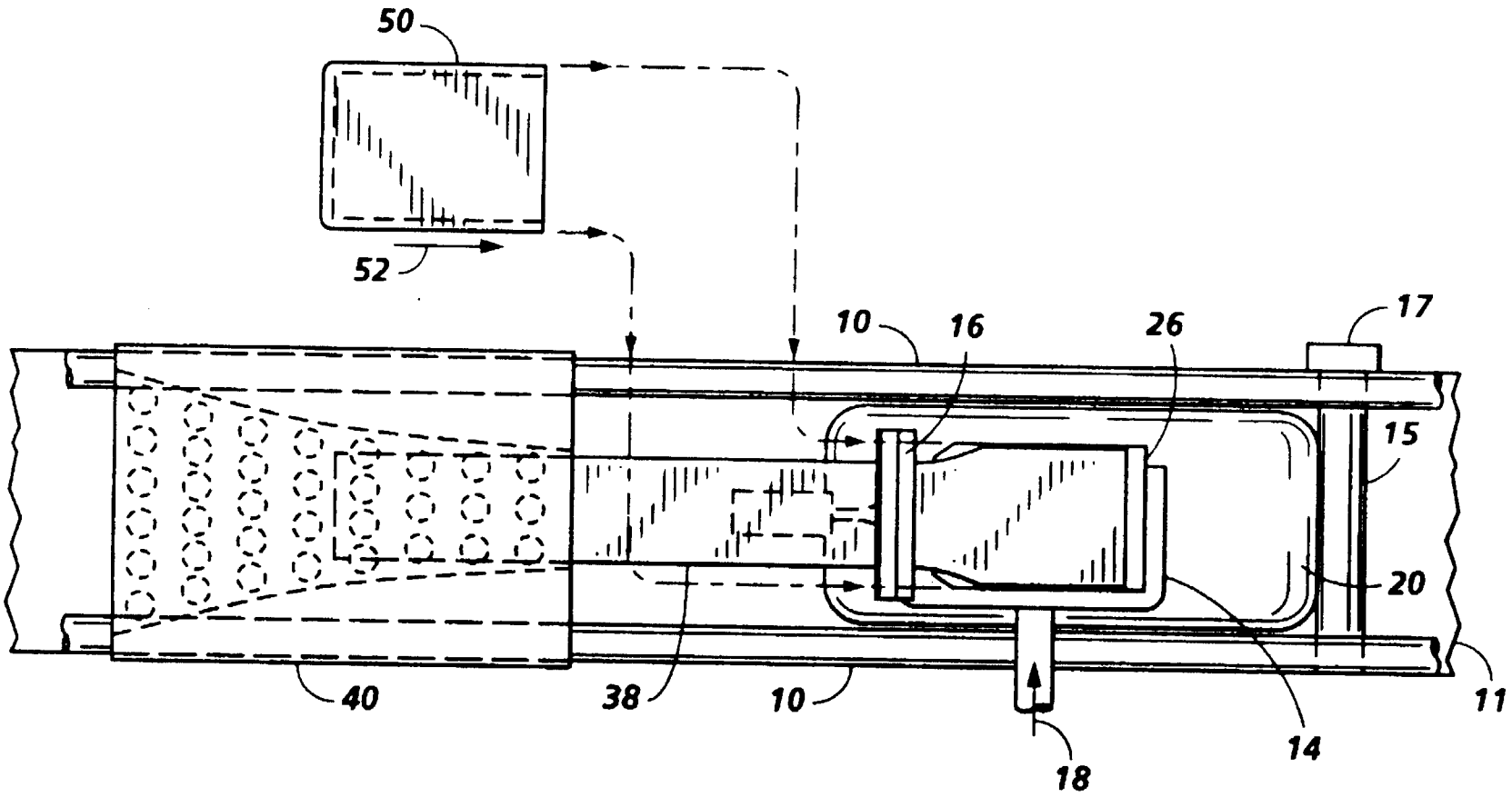
FIG. 2 shows a plan view of the FIG. 1 machine.

As the container moves along the guide rails, it passes under vacuum source 40. The vacuum source 40 is preferably located approximately ½ inches to 1 inch above the container and includes a vacuum manifold 42 and a perforated plate 44. When the container enters the area of the vacuum source, the portion of the tab nearest the fold is initially drawn upwards by the vacuum source. As the container continues to move past the vacuum source, the tab is held flat against the perforated plate by the vacuum source, the tab sliding along the length of the perforated plate. As shown in FIG. 2 the holes in the perforated plate are preferably tapered in the direction of the container movement so that the tab is properly centered over the container opening. The vacuum source is preferably a continuous vacuum source which is of sufficient force to hold the tab portion taut, however not too strong to impede the movement of the container as it moves along the conveyor belt. The vacuum source pressure is preferably approximately 3 to 4 inches Hg.

Once the container is in the correct position, it is automatically captured by a yoke 14 which raises the container to a stop 16 which pinches the tab. The correct position for the container is determined by an escapement 15 which positively stops the movement of the container along the conveyor. When the container is in the correct position a proximity switch 17 is triggered which causes the yoke to operate. The yoke has a U-shaped configuration and moves toward the container in the direction of arrow 18. The yoke engages the container neck 22 on three sides under the flange portion 26. The yoke then moves the container upwardly towards the stop in the direction of arrow 19, the yoke's stroke being designed so that the closure and container are snugly held between the yoke and the stop at full stroke.

The tab is long enough so that the vacuum source continues to hold the tab taut as the container is moved into the raised position against the stop. The stop 16 is preferably an elastomeric stop which is at least as wide as the tab and is oriented so that the entire width of the tab comes into contact with the stop. In this position the tab is properly aligned, taut and clamped.

The stop and yoke hold the tab in the correct position for a lid 50 to be placed over the closure portion on the container. The lid 50 is constructed of an extruded high density polyethylene material and slidably engages, in the direction indicated by arrow 52, the flange member at the neck portion of the container to locate the lid completely over the open end of the container. The lid maintains the tab of the closure folded over the sealed portion and is used in positioning the container when thee container is unsealed.

It is, therefore, apparent that there has been provided, in accordance with the present invention, a container closure that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations that fall within the spirit and scope of the appended claims.

What is claimed is:

1. A method of positioning a closure for a container comprising:

attaching a first portion of the closure to the container;

holding releasably, using a vacuum source which is located remotely from the container, a second portion of the closure;

maintaining the closure under tension; and positioning the closure and the container relative to one another to place the closure in a closing relationship with an opening in the container.

2. A method of positioning a closure as claimed in claim 1, wherein said attaching step comprises sealing said first portion of the closure around the container opening.

3. A method of positioning a closure as claimed in claim 2, wherein said attaching step further comprises folding said second portion of the closure over said first portion of the closure.

4. A method of positioning a closure as claimed in claim 1, wherein said maintaining step comprises moving the container in a first direction transverse to the force of the vacuum source.

5. A method of positioning a closure as claimed in claim 4, wherein said positioning step comprises moving the container in a second direction which is transverse to the first direction.

6. A method of positioning a closure as claimed in claim 5, wherein said positioning step further comprises pinching the closure between the container and a stop.

7. A method of positioning a closure as claimed in claim 1, wherein said positioning step comprises positioning the container and closure against a stop so that the closure is pinched between the closure and said stop.

8. A method of positioning a closure as claimed in claim 1, further comprising placing a lid on the container.

9. A method of positioning a closure as claimed in claim 8, wherein the placing comprises sliding the lid onto the container.

10. A method of positioning a closure as claimed in claim 1, wherein said closing relationship is a sealing relationship.

11. An apparatus for positioning a closure having a first end thereof attached to a container moving along a path, comprising:

means for releasably securing a second end of the closure to maintain the closure under tension as the container moves along the path; and means, responsive to the closure being maintained under tension, for moving the container in a direction substantially transverse to the path to position the second end of the closure in a closing relationship with an opening in the container.

12. An apparatus for positioning a closure as claimed in claim 11, wherein the releasably securing means comprises a vacuum source.

13. An apparatus for positioning a closure as claimed in claim 11, further comprising a transport which moves the container along the path.

14. An apparatus for positioning a closure as claimed in claim 11, wherein the moving means comprises a yoke which captures the container in response to the container reaching a predetermined position.

15. An apparatus for positioning a closure as claimed in claim 14, wherein the yoke is operated by a proximity switch activated in response to the container reaching the predetermined position.

16. An apparatus for positioning a closure as claimed in claim 14, further comprising a stop against which said moving means positions the closure and container to pinch the closure between the stop and the container.

17. An apparatus for positioning a closure as claimed in claim 16, further comprising a lid applied to the container in response to the container being positioned against the stop.

18. An apparatus for positioning a closure as claimed in claim 11, wherein said closing relationship is a sealing relationship.

* * * * *